US006142912A

United States Patent [19]

Profaci

[11] Patent Number: 6,142,912

[45] Date of Patent: Nov. 7, 2000

[54] SWIM TRAINING APPARATUS

[76] Inventor: John Profaci, 16 Dehart Rd., Maplewood, N.J. 07040

[21] Appl. No.: 09/197,084

[22] Filed: Nov. 19, 1998

[51] Int. Cl.[7] ..... A63B 69/10

[52] U.S. Cl. ..... 482/8; 482/55; 482/56; 434/254

[58] Field of Search ..... 482/4–9, 51, 55, 482/56, 148; 434/254

[56] References Cited

U.S. PATENT DOCUMENTS

| | | |
|---|---|---|
| 149,249 | 3/1874 | Redfearn . |
| 326,247 | 9/1885 | Root . |
| 350,932 | 10/1886 | Keating . |
| 1,176,365 | 3/1916 | Harnett . |
| 1,966,448 | 7/1934 | Kabisius . |
| 2,434,542 | 1/1948 | Borroughs . |
| 2,497,391 | 2/1950 | Becker . |
| 3,074,716 | 1/1963 | Mitchel et al. . |
| 3,731,921 | 5/1973 | Andrews, Jr. . |
| 3,791,646 | 2/1974 | Marchingnoni . |
| 4,422,634 | 12/1983 | Hopkins . |
| 4,537,396 | 8/1985 | Hooper . |
| 4,674,740 | 6/1987 | Iams et al. . |
| 4,830,363 | 5/1989 | Kennedy . |
| 4,844,450 | 7/1989 | Rodgers, Jr. . |
| 4,948,119 | 8/1990 | Robertson, Jr. . |
| 5,158,513 | 10/1992 | Reeves ..... 482/56 |
| 5,282,748 | 2/1994 | Little . |
| 5,393,280 | 2/1995 | Haviv ..... 482/56 |
| 5,540,591 | 7/1996 | Doane ..... 482/56 |
| 5,957,815 | 9/1999 | Labrenz ..... 482/56 |

FOREIGN PATENT DOCUMENTS

| | | |
|---|---|---|
| 831721 | 9/1938 | France . |
| 485304 | 7/1927 | Germany . |
| 221098 | 9/1924 | United Kingdom . |
| 369829 | 3/1932 | United Kingdom . |
| WO86/01420 | 3/1986 | WIPO . |

*Primary Examiner*—Glenn E. Richman
*Attorney, Agent, or Firm*—Gary M. Cohen

[57] ABSTRACT

A swim training apparatus which operates to correctly combine the various attributes of a correctly executed crawl or freestyle stroke is generally comprised of a table and a hand track system which combine to simulate the desired attributes of the properly executed stroke. Each arm is allowed to work as though it was progressing below the water's surface while the opposite arm recovers freely and completely, and unencumbered by any handles, levers, cables or other attachments, to practice high elbow recovery form. In addition, each arm is guided through a preset, yet adjustable path that replicates a properly executed crawl or freestyle stroke. This is accomplished while also allowing the user's torso to rotate to the significant degree necessary to simulate desired body rotation in the water.

54 Claims, 13 Drawing Sheets

SWIM TRAINING APPARATUS

BACKGROUND OF THE INVENTION

The present invention generally relates to a swim training device, and more particularly, to an apparatus which can be used to exercise and practice the swimming technique generally known as the crawl or freestyle stroke.

A variety of sports training devices have been devised to facilitate in the training of individuals in the exercise and practice of various swimming techniques (i.e., strokes). The present description is primarily directed to one such stroke, that being the crawl or freestyle stroke. However, a similar approach may be used to facilitate in the training of individuals in other strokes, if desired.

There are a variety of situations in which it would be desirable to have the availability of a device that can either help teach a non-swimmer proper freestyle stroking form, or to allow a person with prior knowledge of the freestyle stroke to practice and/or to strengthen his or her form. For example, it may be desirable to allow a beginner to learn a freestyle stroke while out of the water, to gain confidence prior to entering the water. It may also be desirable to allow a more advanced swimmer to practice his or her form out of the water, for example, in situations where a swimming pool of the desired size (e.g., an "Olympic" sized pool) is not readily available, or where it would be useful for a trainer coaching the swimmer to closely follow the swimmer's activities to refine the swimmer's form.

Prior devices for facilitating swim training primarily rely upon mechanical expedients such as pull-strings, rotating handles and other similar means to define the arm and/or leg motion which is desired for the swim stroke being practiced. However, these devices all suffer from a common shortcoming in that each operates to emphasize the development and practice of swimming mechanics that emphasize (and develop) arm and shoulder pulling strength, or leg kicking strength. This is self-limiting since swimming does not rely entirely on muscle strength, but rather is heavily reliant upon the development of proper swimming technique and the ability to develop efficient swimming habits. This is equally so for the inexperienced swimmer, where it is important to ensure sufficient energy for satisfying basic distance requirements, or for the more experienced, competition swimmer, where even small differences in technique can mean the difference in overall outcome. The primary reason for this is that incorrect swimming form can cause the body to work harder than necessary, preventing efficient swimming and promoting fatigue despite the apparent strength of a given individual.

Correct freestyle swimming requires both concentration and practice, and the mastering of five elemental components. These components include hand entry, pull, body rotation, push and elbow recovery. The benefit derived from exercising proper form is that the energy expended with each stroke is utilized more effectively, to propel the body farther than if improper form is occurring. As a result, proper technique allows a person to swim for a longer period of time, and without fatiguing, a consideration which can in many cases be critical to outcome. The following discussion is provided to briefly describe the five elemental components which contribute to the development of proper freestyle mechanics.

Hand entry pertains to that part of each stroke where the hand enters the water, from overhead. During such entry, the hand should penetrate the surface of the water with the palm facing outwardly and with the thumb facing downwardly, to in essence "cut" into the water as smoothly as possible without slapping the water's surface or creating bubbles. This, in turn, operates to eliminate excessive drag during the hand entry phase.

The hand should continue to slide forward until a full extension is reached, which will also generally result in some rotation of the torso. At the point when the hand entering the water can reach no further, with the shoulder fully extended (causing the torso to begin a rotation), the opposite hand will be finishing the final stages of its stroke and will lift from the water, somewhere along the thigh. The entering hand will then begin its "pull" backward. During this pull, flexing of the hand and cupping of the water serves to develop a "paddle" for propelling the body forward. Also during the pull, the elbow is bent and the hand is carried from its point of full extension (somewhere in front of the shoulder) through an imaginary line in front of the chest, and then back toward the side of the thigh, to produce what is essentially an "S-shaped" motion.

The body will naturally rotate as the lead hand is extended to its limit. With the torso rotated, the head has the ability to surface for a breath. A simple turn at this point is preferred to avoid an unnecessary, jerky motion during breathing. A swimmer who does not rotate his or her body with each stroke will tend to swim flat on the chest (i.e., somewhat like a "barge"), and cannot cut through the water as efficiently as a swimmer who is constantly rotated onto the side (i.e., angled and propelled through the water like a "schooner").

When the pulling arm reaches the waist, the tendency is for the swimmer to take the hand out of the water while the elbow is still bent. However, most swimmers do not realize that a final "push" of the flexed hand down along the thigh utilizes the momentum of the paddle to propel the body even further.

The hand then exits the water, with the elbow raised high to allow the forearm and hand to dangle and rest completely as the hand is brought forward to prepare for the next entry. High elbow recovery is a key factor in strength conservation in the forearm and wrist muscles once the stroke has been finished and the hand is positioned above the surface (for re-entry).

Prior devices have tended not to encourage the user to perform a freestyle stroke using the correct technique, failing to support the goal of learning proper and efficient stroking. Such devices generally tend to fall into two categories, neither of which can encourage proper relaxation during the recovery portion of a freestyle stroke (i.e., when each arm leaves the water) or allow the user to adjust hand posturing (generally due to constant attachment of the user's hands to grips, handles or levers associated with the device).

One such category includes devices of the type having fixed hand grips, attached for example to retractable cables or cords. This would include devices such as are disclosed in U.S. Pat. No. 5,158,513 (Reeves), U.S. Pat. No. 4,948,119 (Robertson, Jr.), U.S. Pat. No. 4,844,450 (Rodgers, Jr.), U.S. Pat. No. 4,830,363 (Kennedy), U.S. Pat. No. 4,537,396 (Hooper), U.S. Pat. No. 2,434,542 (Borroughs) and U.S. Pat. No. 350,932 (Keating).

The second such category includes devices of the type having arm cranks or levers, which then requires some form of handle to be constantly gripped by the user (in order to rotate the arm cranks in a fixed elliptical pattern). This would include devices such as are disclosed in U.S. Pat. No. 5,282,748 (Little), U.S. Pat. No. 4,674,740 (Iams et al.), U.S. Pat. No. 4,422,634 (Hopkins), U.S. Pat. No. 3,791,646 (Marchignoni), U.S. Pat. No. 3,731,921 (Andrews, Jr.), U.S.

Pat. No. 3,074,716 (Mitchel et. al.), U.S. Pat. No. 2,497,391 (Becker), U.S. Pat. No. 1,966,448 (Kabisius), No. U.S. Pat. 1,176,365 (Hartnett), U.S. Pat. No. 326,247 (Root) and U.S. Pat. No. 149,249 (Redfearn).

To properly teach and/or simulate a crawl or freestyle stroke, it is equally important to replicate correct body rotation. Two prior devices that work to provide torso motion would include the previously mentioned U.S. Pat. No. 4,674,740 (Iams et al.) and U.S. Pat. No. 5,158,513 (Reeves). U.S. Pat. No. 4,674,740 discloses a gimballing apparatus that allows the user's torso to rock from side to side. While achieving a rolling body motion, this design does not allow the user to achieve the full degree of rotation that is to occur in a freestyle stroke, particularly for the more aggressive swimmer. U.S. Pat. No. 5,158,513 also discloses a device that allows for torso motion to replicate the body rotation occurring in water, while swimming. However, such rolling motion is achieved by a "teeter-totter" rolling over a cylindrical support, which again limits the degree of rotation that is possible with such a device.

For these reasons, none of the devices disclosed in the above-listed patents can achieve or fulfill the purpose of correctly replicating the crawl or freestyle stroke, and it is therefore the primary object of the present invention to meet the need for such a device.

It is also the object of the present invention to avoid the need for the user's arms and hands to engage grips, handles or levers that can tend to develop motion throughout each stroke which is in some way not characteristic of an actual swim stroke.

It is also an object of the present invention to provide a swim training device which can correctly teach and/or replicate all five of the elemental components of a crawl or freestyle stroke.

It is also an object of the present invention to provide a swim training device which can correctly teach and/or replicate both the hand/arm motion and the body motion of a crawl or freestyle stroke.

It is also an object of the present invention to provide a swim training device which can correctly teach and/or replicate a crawl or freestyle stroke, and which is versatile, yet easy to use.

SUMMARY OF THE INVENTION

These and other objects which will become apparent are achieved in accordance with the present invention by providing a swim training apparatus that operates to correctly combine the various attributes of a correctly executed crawl or freestyle stroke. To this end, the apparatus is generally comprised of a table and a hand track system which combine to simulate the following overall attributes. During the beginning of each stoke motion, the hand is required to assume a position in which the palm faces outwardly while the thumb faces downwardly. Each arm is allowed to work as though it was progressing below the water's surface while the opposite arm recovers freely and completely, and unencumbered by any handles, levers, cables or other attachments, to practice high elbow recovery form. In addition, each arm is guided through a preset, yet adjustable path that replicates an "S-shaped" path below the body, as is recommended for a crawl or freestyle stroke, and that also allows the user to customize the stroke reach and depth so as to better accommodate users of a different size. Full arm extension is encouraged upon the completion of each stroke, as well as at the beginning of each stroke, and the tension of the stroke can be adjusted to fit the needs of a particular user. This is accomplished while also allowing the user's torso to rotate to the significant degree necessary to simulate desired body rotation in the water.

In accordance with a preferred embodiment of the present invention, this is accomplished with a swim training apparatus which is generally comprised of a table for receiving a user of the device, and a cooperating hand track system that surrounds the user while the user is supported in desired position by the table. The table includes a tray for supporting the user in a generally horizontal position simulating the user's body while in the water. The tray is supported on the table so that the tray can freely rotate about a longitudinal axis that coincides with the user's body, through a significant arc of rotation. The hand track system includes a pair of tracks shaped to simulate the hand movement which is desired for a correctly executed crawl stroke. Each track includes a paddle system for receiving the user's hands during the entry, pull and push phases of a stroke, and for guiding the received hand and arm into their correct position during the simulated stroke while allowing the hand and arm to freely progress without interference from the hand track system through the elbow recovery phase of the stroke.

As a result, the hands and arms are kept free of interfering attachments during the recovery phase of each stroke, providing a more accurate simulation of the upper portion of the swimming stroke. This, in turn, allows the user to practice, and to become more accustomed to natural (correct) swimming form than was previously possible.

For further discussion of the swim training device of the present invention, reference is made to the detailed description which is provided below, taken in conjunction with the following illustrations.

DETAILED DESCRIPTION OF PREFERRED EMBODIMENTS

Figure 1:
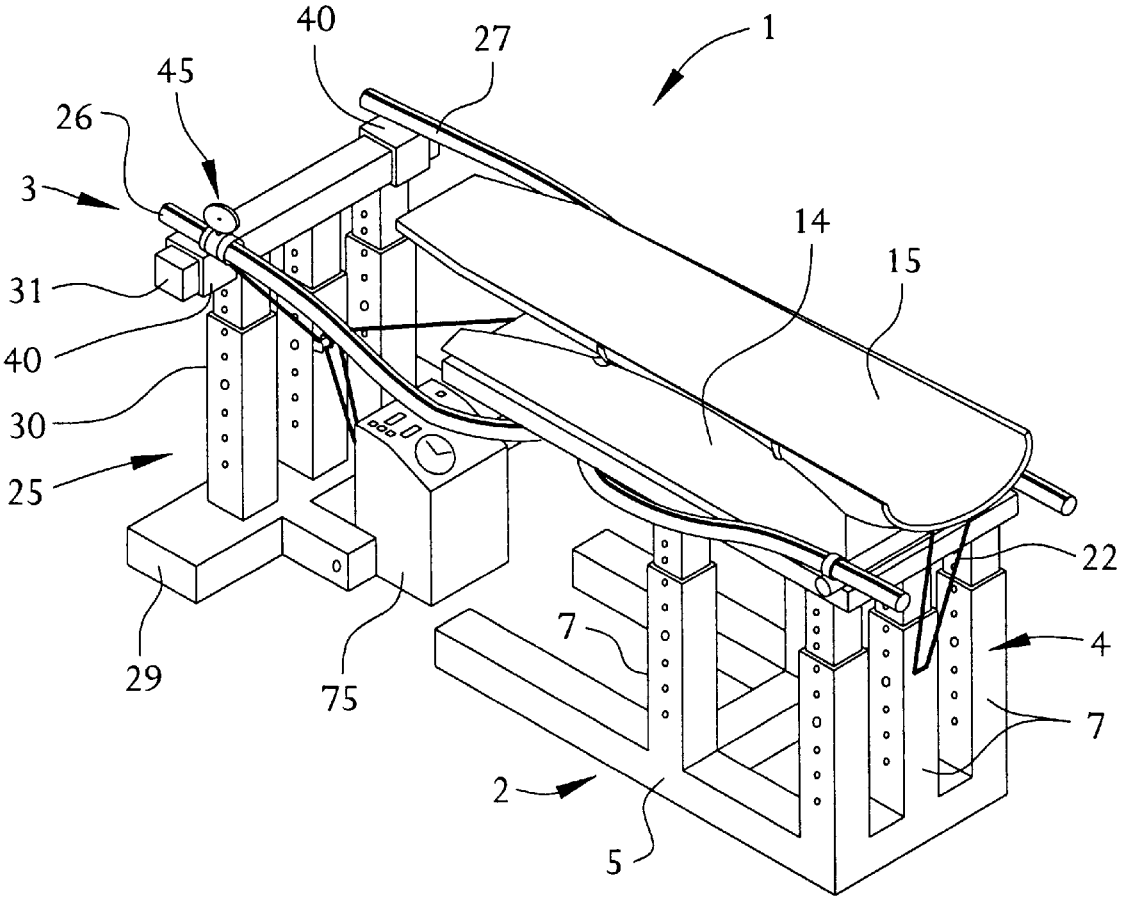
FIG. 1 is an isometric view of a preferred embodiment swim training apparatus produced in accordance with the present invention.
Figure 2:
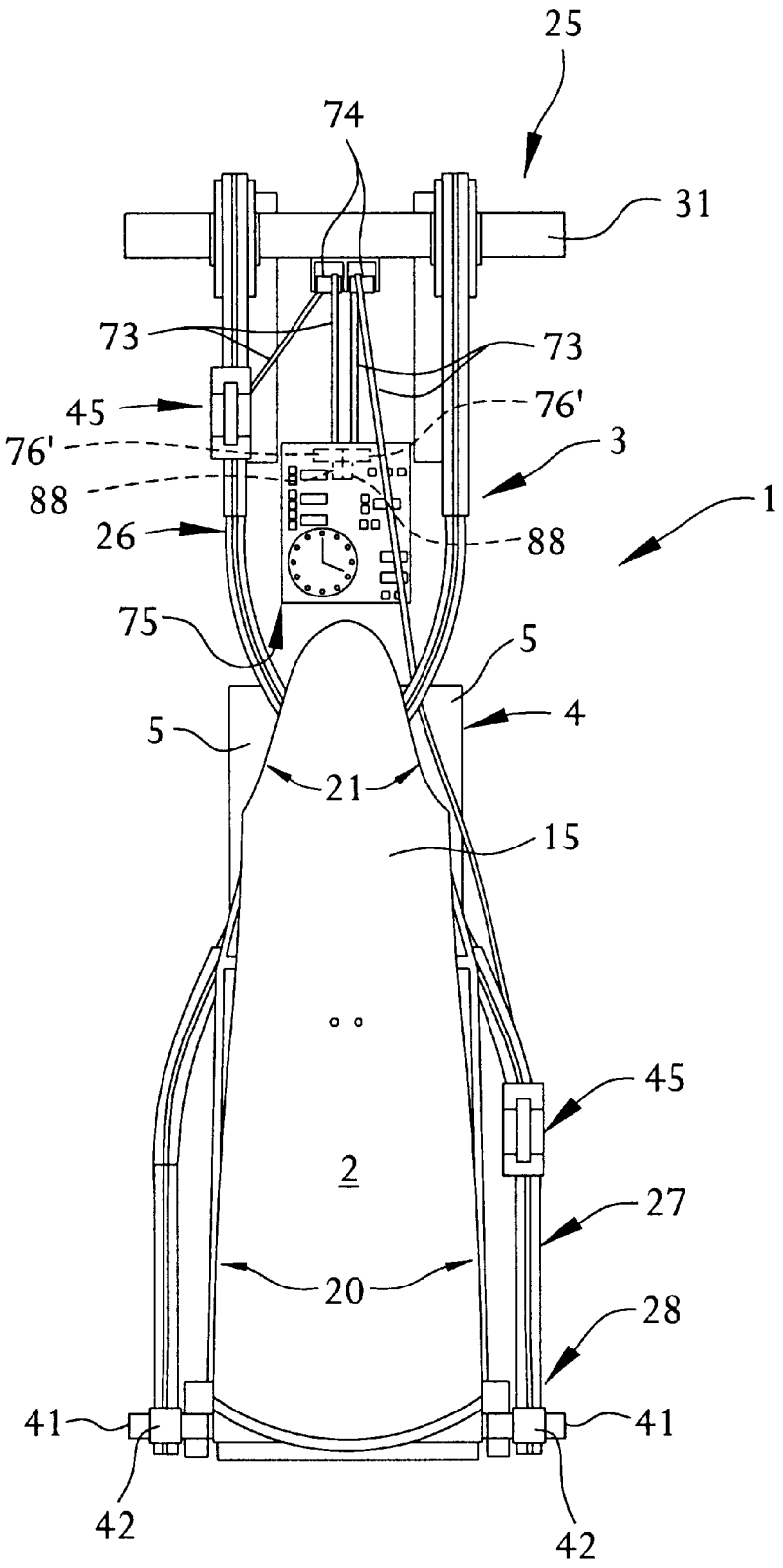
FIG. 2 is a top plan view of the swim training apparatus shown in FIG. 1.
Figure 3:
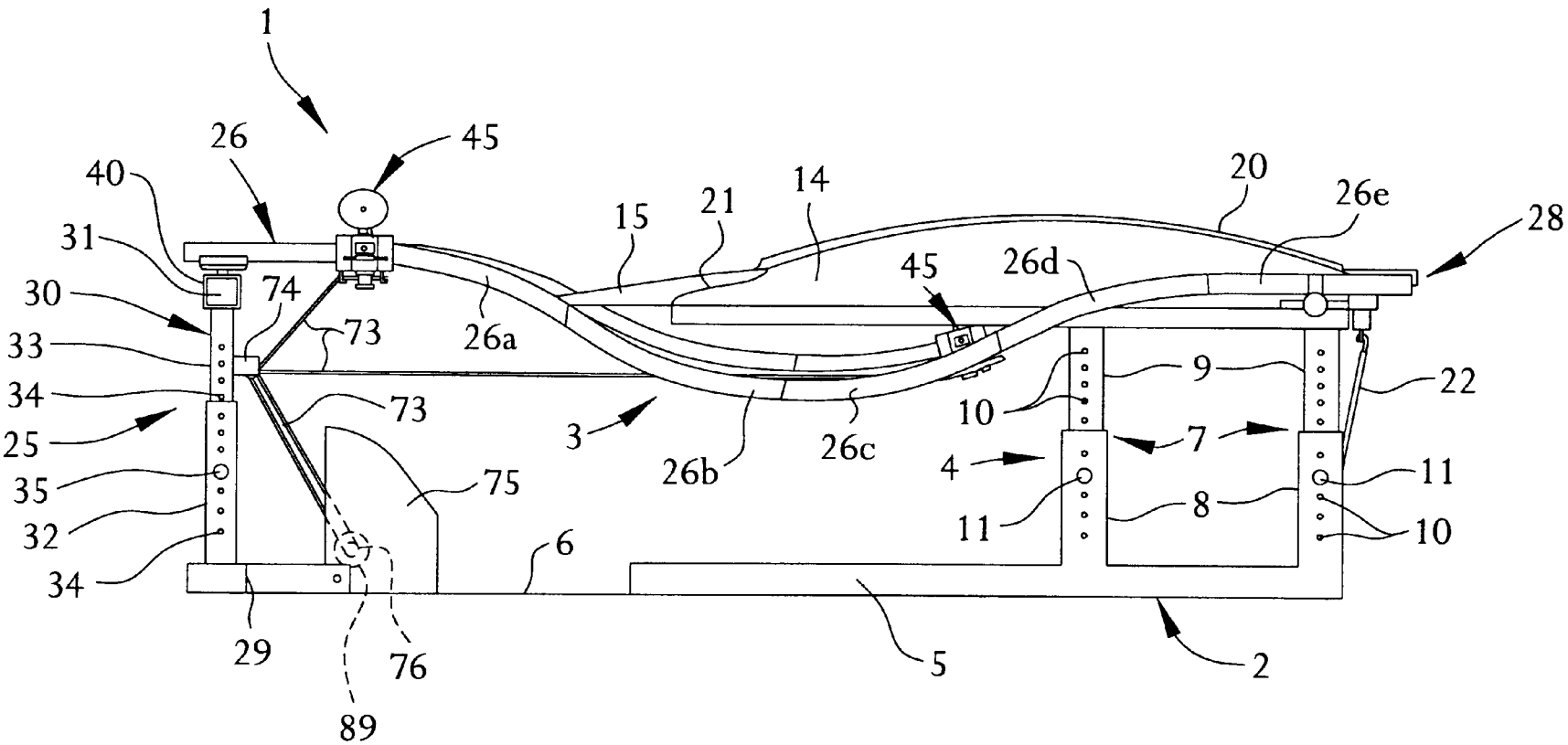
FIG. 3 is a side elevational view of the swim training apparatus shown in FIG. 1.
Figure 4:
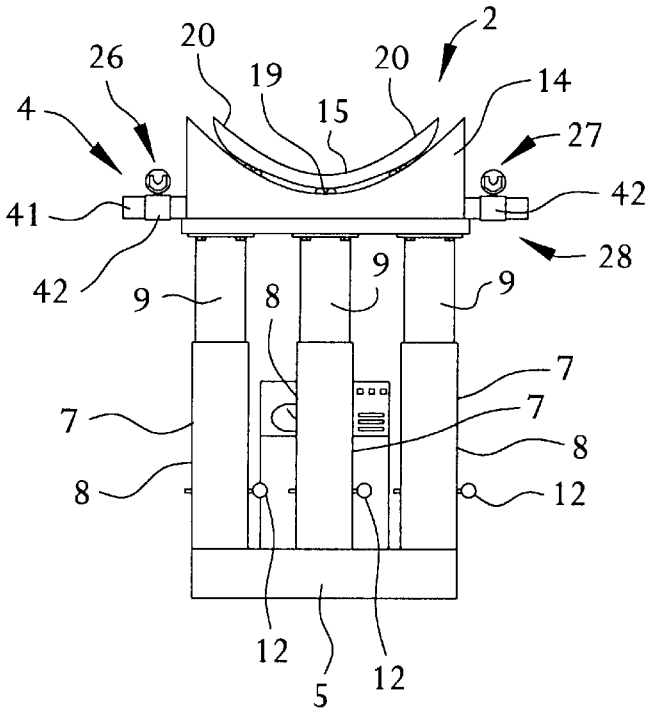
FIG. 4 is an end elevational view of the swim training apparatus shown in FIG. 1, as viewed from the rear.
Figure 5:
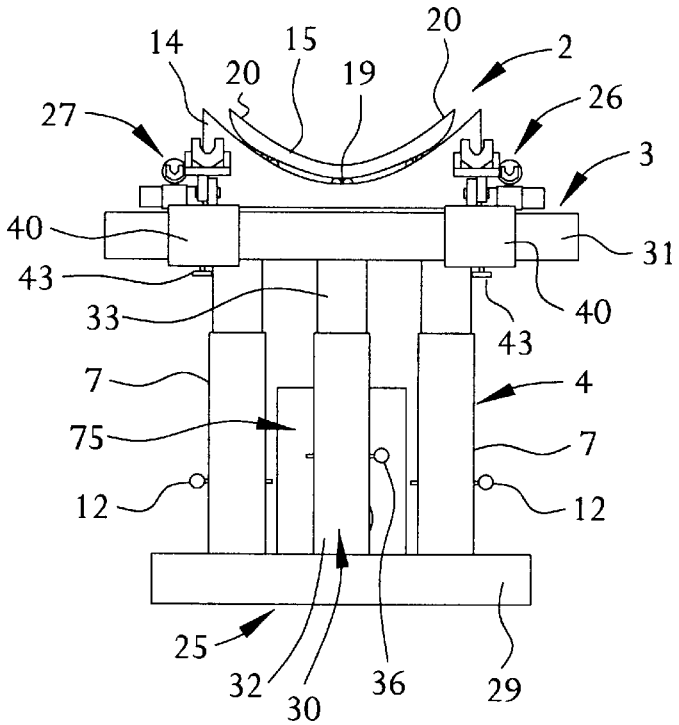
FIG. 5 is an end elevational view of the swim training apparatus shown in FIG. 1, as viewed from the front.
Figure 6:
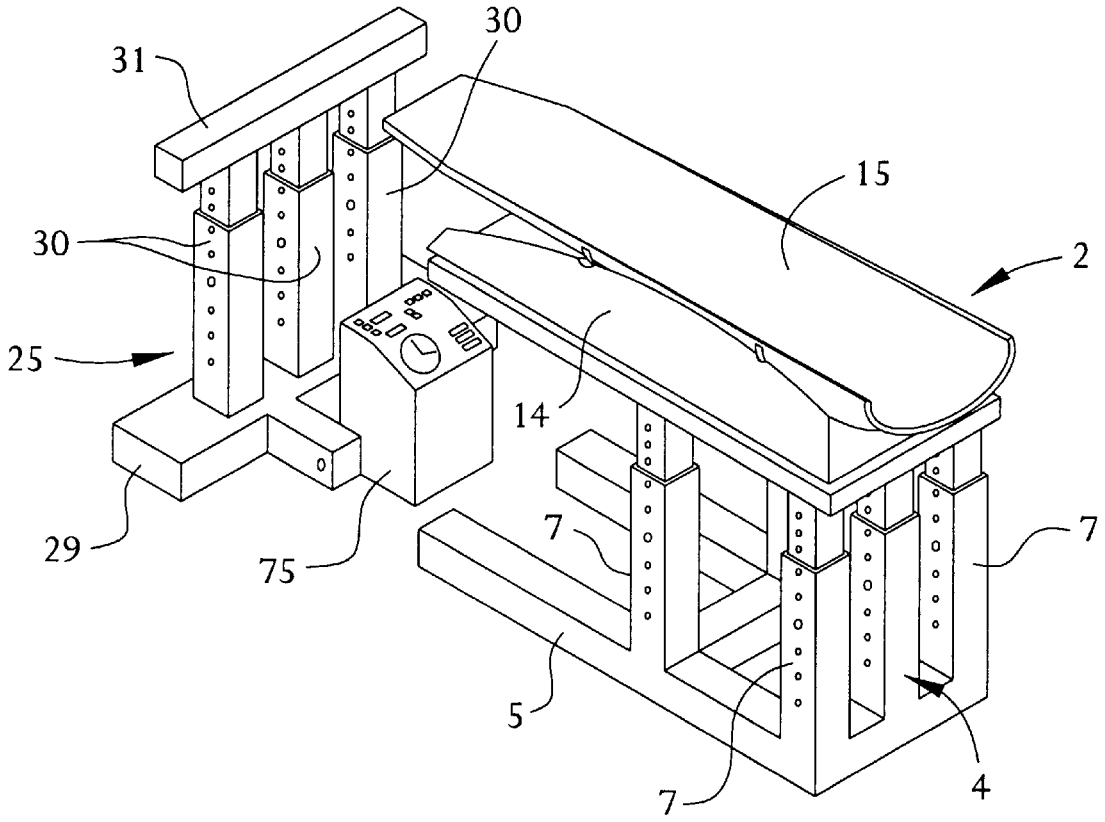
FIG. 6 is an isometric view of the table of the swim training apparatus shown in FIG. 1, with the track system removed to more clearly reveal construction detail.
Figure 7:
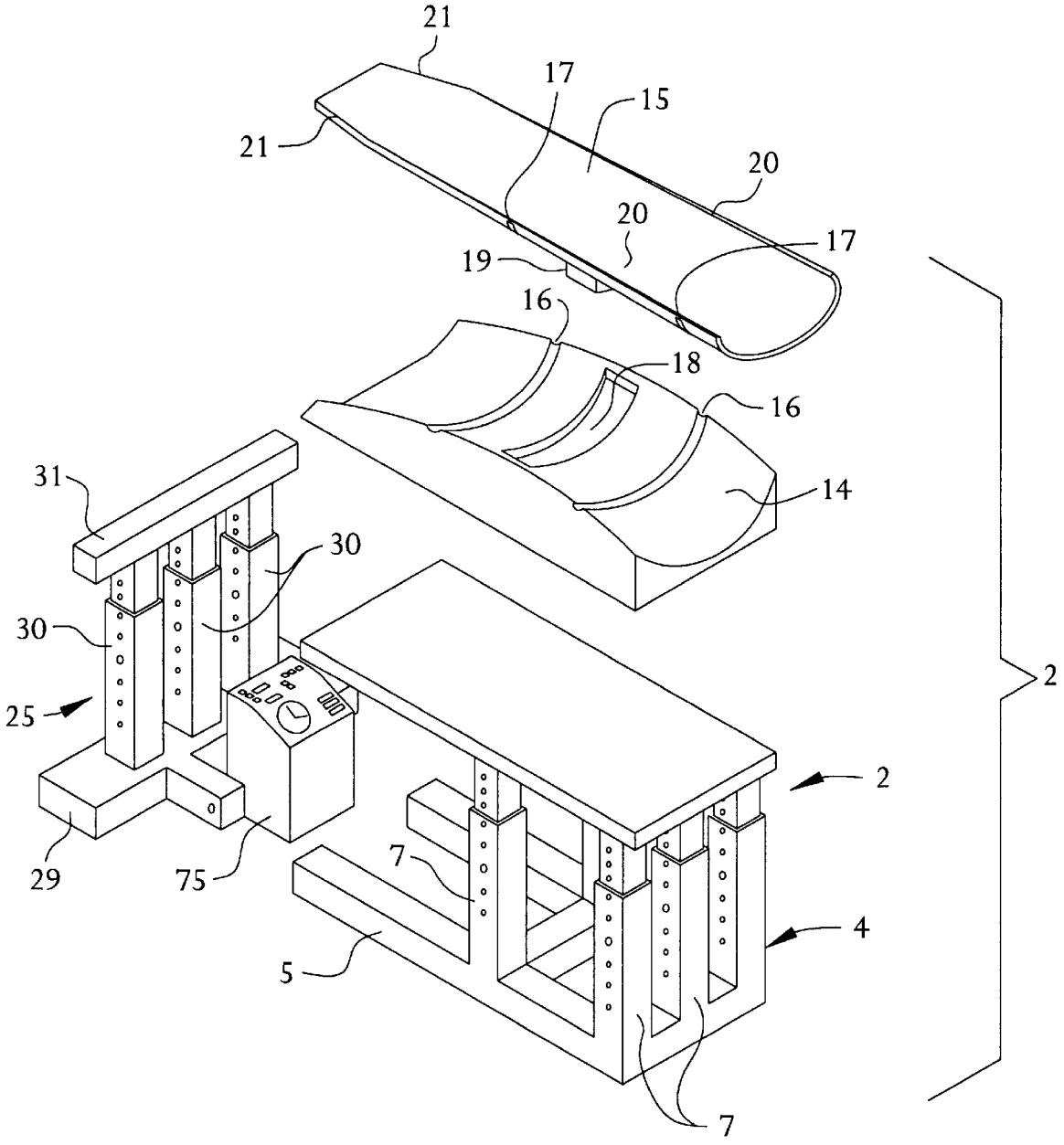
FIG. 7 is an exploded view of the table shown in FIG. 6.

FIG. 1 shows a preferred embodiment swim training apparatus 1 which is particularly well suited to instruction of the crawl or freestyle stroke. The swim training apparatus 1 is generally comprised of a table 2 coupled with a hand track system 3. The table 2 is configured to received a user so that the user is supported in a generally horizontal orientation similar to the position the user would assume while in the water, and so that the hands and arms of the user can extend freely from the table 2 toward the hand track system 3. The hand track system 3 is engaged by the hands of the user, as will be discussed more fully below, for purposes of simulating a freestyle stroke. While the discussion which follows will be directed to an apparatus useful in simulating a freestyle stroke, it is to be understood that a similarly configured apparatus could also be used to simulate other strokes, if desired, by suitably varying the configuration and the relative position of the various components comprising the swim training apparatus 1.

Referring to FIGS. 1 through 7, the table 2 generally includes a support 4 for receiving the user of the apparatus 1, and a base 5 for resting upon a desired surface 6. A series of telescoping struts 7 extend between the support 4 and the base 5 to maintain the user of the apparatus 1 at a height above the surface 6 which is sufficient to permit full travel of the user's hands and arms while the apparatus 1 is in use.

Each of the telescoping struts 7 includes a sleeve 8 for slidingly receiving a post 9. The sleeve 8 and the post 9 each include a series of apertures 10 for receiving a pin 11 so that the extension of the telescoping struts 7 can be suitably adjusted to a particular user. Each of the pins 11 is preferably secured in position by a locking device, for purposes of user safety. For example, the wing nuts 12 shown in FIG. 4 can be used to develop a threaded, locking engagement at this interface.

The support 4 includes a frame 14 which is fixed to the several telescoping struts 7 associated with the table 2, and a tray 15 which is received by the frame 14 so that the tray 15 (and the user on the support 4) can rotate about an axis which extends longitudinally through the user of the apparatus 1. To this end, the frame 14 and the tray 15 are coupled by bearing structures that permit longitudinal rotation of the tray 15, but which prevent longitudinal shifting of the tray 15 relative to the table 2. This is preferably accomplished by providing the frame 14 with a curved track 16, and by providing the tray 15 with a correspondingly curved race 17 for engaging the track 16. The frame 14 further includes a channel 18 for receiving a stop 19 extending from beneath the tray 15, to safely limit movement of the tray 15 relative to the frame 14 (i.e., "over-rotation") without interfering with proper (desired) body rotation.

The tray 15 is preferably contoured in shape, as shown, providing raised sides 20 for laterally supporting the user's body and open undercuts 21 for ensuring free travel of the user's arms (i.e., to simulate flotation of the user during swimming). In most cases, it is preferred to allow the tray 15 to move freely relative to the frame 14, to best simulate the free movement which is experienced by the swimmer when in the water. However, for applications where some degree of resistance is desirable, or for purposes of safety, an elastic element (such as the elastic band 22 shown in FIG. 3) can be connected between stationary portions of the support 4 (e.g., the base 5) and the tray 15 to restrict free movement of the tray 15 relative to the frame 14, or to bias the tray 15 toward a neutral (centered) position. The tray 15 is preferably padded, for user comfort.

Referring to FIGS. 1 to 5, the hand track system 3 generally includes a pedestal 25, and a pair of hand tracks 26, 27 extending between the pedestal 25 and rearward portions 28 of the support 4 associated with the table 2.

The pedestal 25 includes a base 29 for resting upon the surface 6, and a telescoping strut 30 extending between the base 29 and a support 31 for receiving the hand tracks 26, 27. The telescoping strut 30 includes a sleeve 32 for slidingly receiving a post 33. The sleeve 32 and the post 33 each include a series of apertures 34 for receiving a pin 35 so that the extension of the telescoping strut 30 can be suitably adjusted to a particular user. The pin 35 is preferably secured in position by a locking device, for purposes of user safety. For example, the wing nut 36 shown in FIG. 5 can be used to develop a threaded, locking engagement at this interface.

The support 31 slidingly receives a pair of adjustable collars 40, each of which in turn receives one of the hand tracks 26, 27. The hand tracks 26, 27 each extend rearwardly from the support 31 to a support 41 associated with the rearward portions 28 of the table 2. The support 41 also slidingly receives a pair of adjustable collars 42, which in turn receive the rearward ends of the hand tracks 26, 27 so that the hand tracks 26, 27 are suspended between the supports 31, 41, extending along the tray 15 associated with the table 2. Lateral adjustment of the position of the hand tracks 26, 27 relative to the tray 15 (and accordingly, the user of the apparatus 1) is accomplished by sliding the collars 40, 42 along the supports 31, 41, as desired. Each of the collars 40 includes a wing nut 43 for securing the hand tracks 26, 27 in their desired position following their adjustment. The collars 42 are preferably left free to move along the support 41 to allow for some movement of the hand tracks 26, 27 responsive to pressure exerted by the user, but can also include wing nuts for fixed engagement with the support 41, if desired.

The hand tracks 26, 27 are symmetrically contoured to define a path corresponding to the path which is to be followed by the hands of the swimmer to properly develop (simulate) a freestyle stroke, as will be discussed more fully below. The hand tracks 26, 27 can be formed as unitary structures, if desired, or as a series of sections (e.g., the sections 26*a*, 26*b*, 26*c*, 26*d* and 26*e* shown in FIG. 3) for ease of assembly, set-up and storage. In the latter case, each of the sections 26*a*, 26*b*, 26*c*, 26*d* and 26*e* will be provided with suitable mating structures for joining the several sections together to form an assembled hand track, such as a narrowed or undercut end for engaging the corresponding opening in an adjacent section (not shown). Pins, screws, or a releasable detent mechanism can be provided to establish a secure, locking engagement between adjacent track sections, if desired.

The illustrated construction of the hand tracks 26, 27 is presently considered preferred since the plural sections of each hand track permit the path developed for a given training routine to be varied (by varying the curvature and the elevation of the resulting path), and since the various structures of the table 2 and the pedestal 25 which are used to engage the hand tracks 26, 27 permit simple adjustment of the slope (or vertical drop) and the extension (or spread) of the hand tracks 26, 27 to meet the individual needs of a particular user. Such hand track constructions are readily implemented using any of a variety of known plastic molding or metal fabricating procedures, and provide the potential for developing interchangeable tracks or track sections for varying the training that can be achieved with the swim training apparatus 1 of the present invention.

Figure 8:
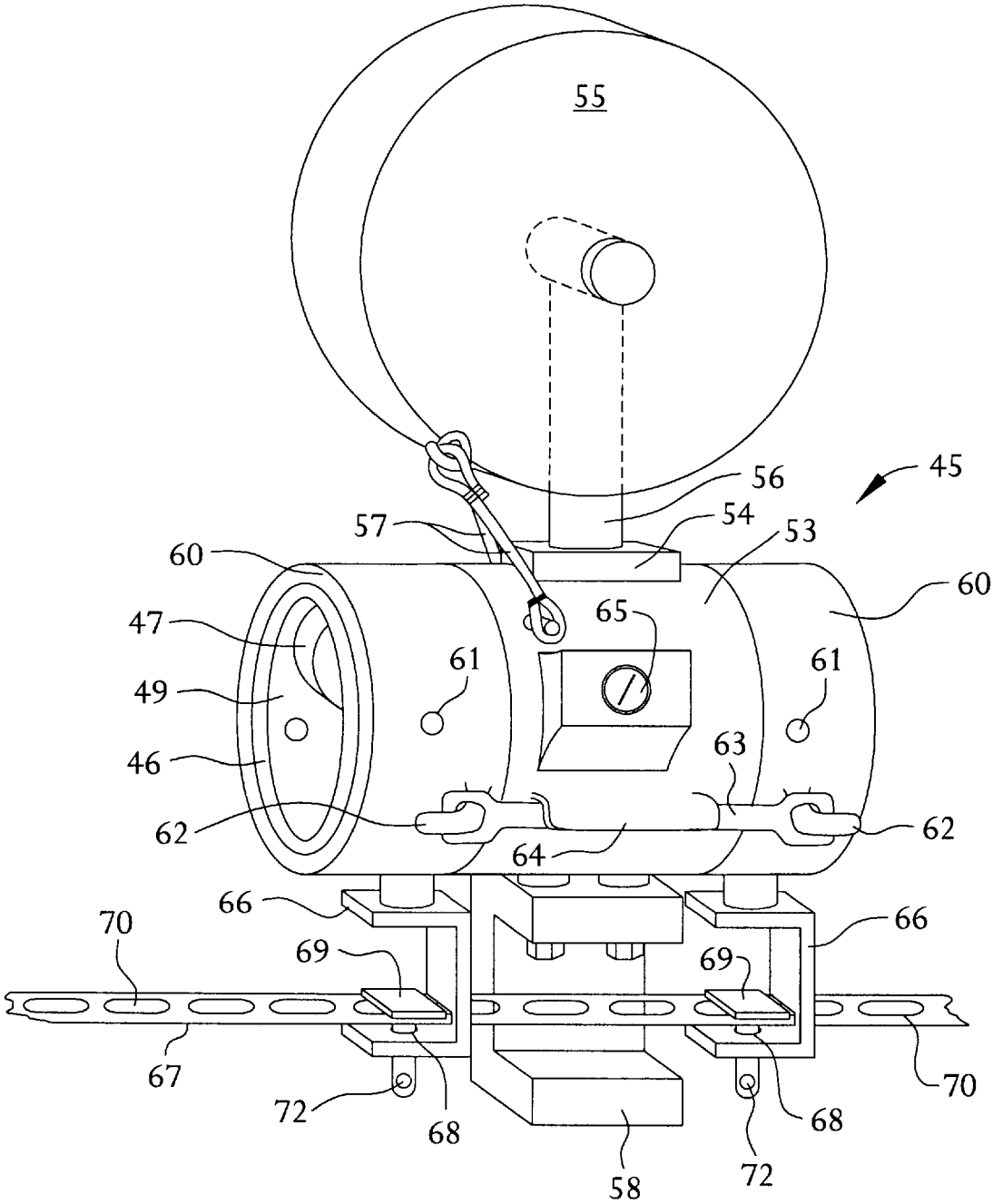
FIG. 8 is an enlarged, side elevational view of one of the paddle assemblies associated with the track system of the swim training apparatus shown in FIG. 1.
Figure 9:
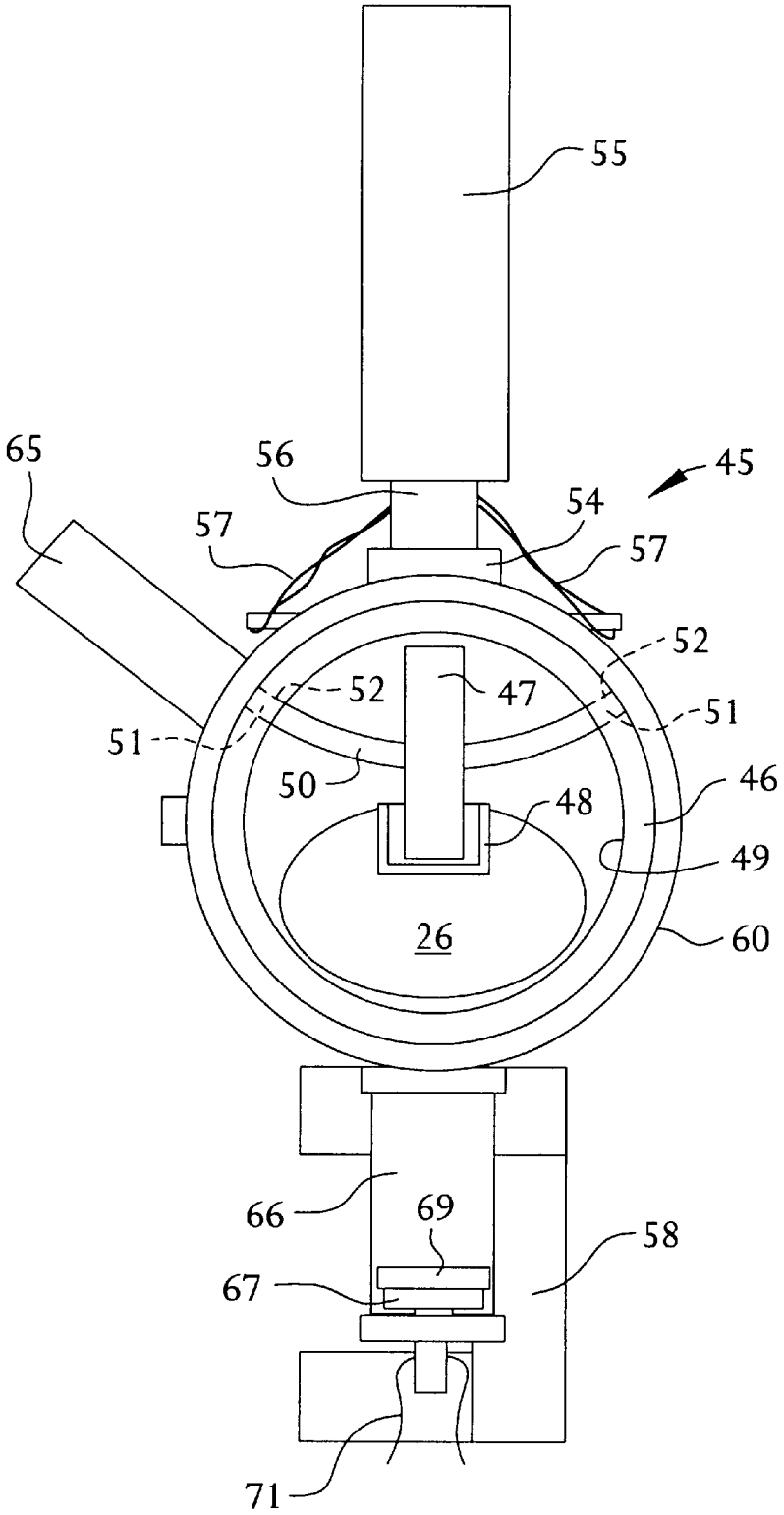
FIG. 9 is a cross-sectional view of the paddle assembly shown in FIG. 8, together with its receiving track.
Figure 10:
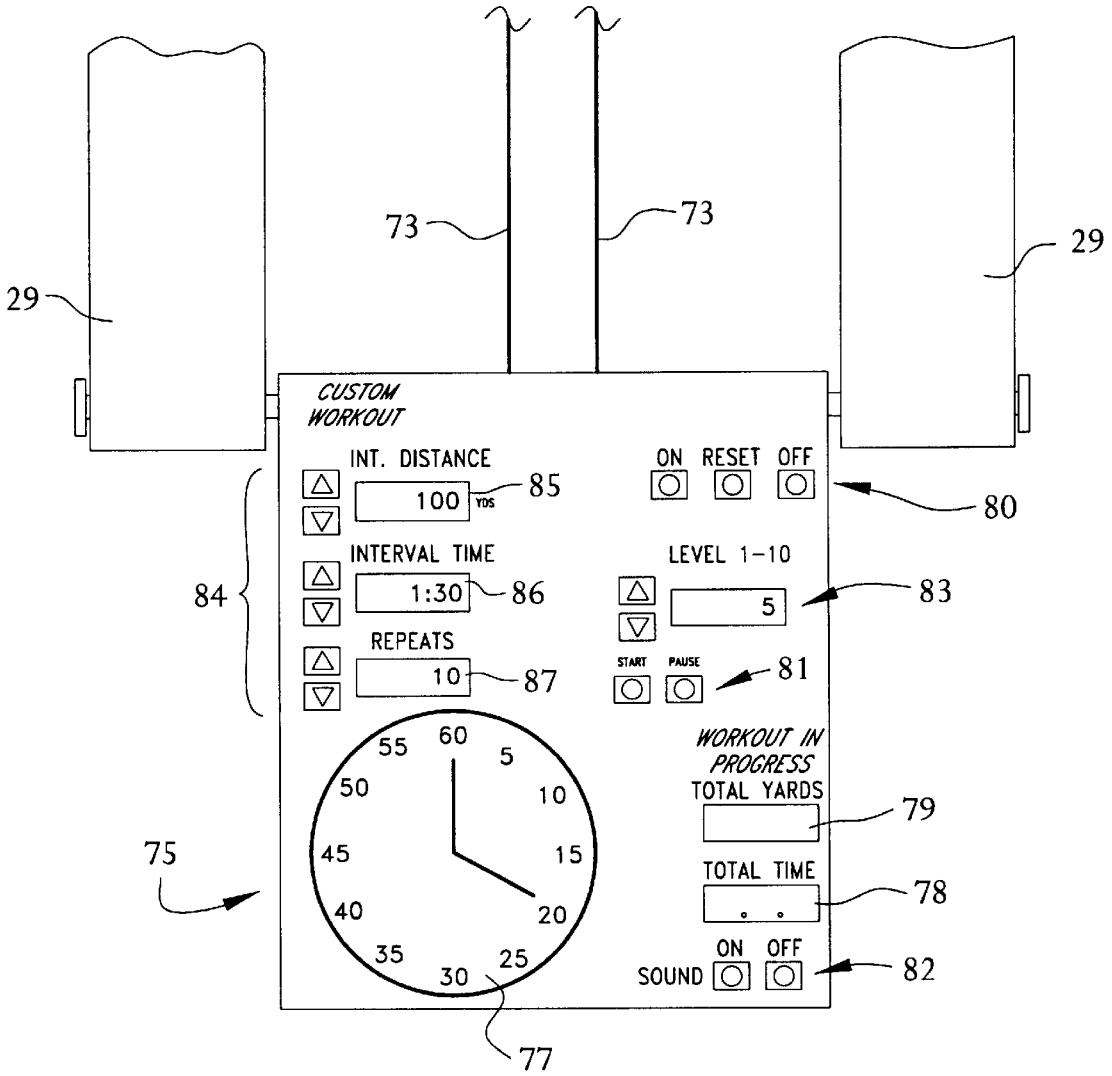
FIG. 10 is an isometric view of the control panel of the swim training apparatus shown in FIG. 1, with the surrounding structures removed to more clearly reveal construction detail.

Each of the hand tracks 26, 27 slidingly receives a paddle assembly 45 that can be engaged by the hands of the user and which is adapted to follow the path defined by the hand track that receives it. The paddle assemblies 45 are symmetrically formed to define left-handed and right-handed engaging surfaces as will be discussed more fully below. However, the overall construction of each paddle assembly is otherwise the same. FIGS. 8 and 9 show the construction of one such paddle assembly 45, in this case the paddle assembly associated with the hand track 26.

The paddle assembly 45 includes an inner cylinder 46, which serves as a sleeve for slidingly engaging the hand track (in this case, the hand track 26). To this end, the inner cylinder 46 includes a pair of rollers 47 for engaging a channel 48 formed in upper portions of the hand track 26, and the hand track 26 is received between the rollers 47 and the inner wall 49 of the cylinder 46 so that the cylinder 46 can smoothly slide along the hand track 26. The hand track 26 preferably has a generally elliptical cross-section to provide proper clearance with the inner wall 49 of the cylinder 46 and to present a smooth surface for purposes of minimizing the potential for injury to the user in the event that the user's arm impacts the hand track 26. A pair of arcuate axles 50 receive the rollers 47 so that the rollers 47 are retained in their desired position. A pair of screws 51 extend through apertures 52 formed in the cylinder 46 to secure the axles 50 (and the rollers 47 received by the axles 50) in position. The screws 51 are preferably countersunk to avoid interfering contact with overlying structures.

An outer cylinder 53 is positioned to overly, and is sized to slidingly engage the inner cylinder 46. Upper portions of the cylinder 53 include a bearing 54 for receiving, and in this way mounting a paddle 55, which is preferably shaped to comfortably receive the user's hand (e.g., the disk shape shown in the drawings). The size and shape of the paddle 55 can be varied, as desired, to meet the needs of different users (e.g., adults, small children, the handicapped, etc.). A shaft 56 connects the paddle 55 and the cylinder 53, and is journalled for rotation within the bearing 54. A pair of elastic bands 57 extend between the paddle 55 and the cylinder 53 to bias the paddle 55 toward the centered position best shown in FIG. 9. Lower portions of the cylinder 53 preferably include a counterweight 58 to bias the paddle 55 toward an upright position so that the paddle 55 is properly positioned for engagement by the user's hand, as will be discussed more fully below.

A pair of sleeves 60 also overly the inner cylinder 46, and extend from opposite sides of the cylinder 53 to prevent the cylinder 53 from sliding longitudinally along the cylinder 46 while allowing the cylinder 53 to freely rotate about the cylinder 46. The sleeves 60 are preferably secured in position over the cylinder 46, and adjacent to the cylinder 53, by one or more attachment screws 61.

Each of the sleeves 60 includes a hook 62 for receiving the opposing ends of an elastic element (e.g., the elastic band 63). The cylinder 53 also includes a hook 64 for engaging the elastic band 63 extending between the sleeves 60. As the user's hand engages the paddle 55 of the assembly 45, as will be discussed more fully below, the cylinder 53 will be caused to rotate about the cylinder 46, against the bias of the elastic band 63. This operates to return the paddle 55 to a generally upright position following release of the paddle 55 by the user, either alone or in conjunction with the counterweight 58, depending upon the degree of resistance that is desired. A stop 65 is provided for engaging a suitable fixed surface (e.g., the adjustment bands 67 to be described below) to limit travel of the cylinder 53 about the cylinder 46 responsive to pressure applied by the user's hand, to avoid the potential for interfering contact with other structures.

Each of the sleeves 60 also includes a bracket 66 that extends downwardly from the paddle assembly 45. The brackets 66 are used to engage a band 67 associated with each of the paddle assemblies 45. The bands 67 are used to adjustably position the paddle assemblies 45 along the hand tracks 26, 27, for proper engagement by the user's hands. To this end, the brackets 66 include an aperture 68 for releasably receiving an engagement pin 69, and the bands 67 are provided with a corresponding series of apertures 70 for selective engagement by the pins 69 so that the swim training apparatus 1 (i.e., the location of the paddles 55) can be adjusted to a particular user. A clip 71 is preferably inserted through an aperture 72 extending through the end of each pin 69 to maintain this adjustment, once made, and to prevent separation of the paddle assembly 45 from the band 67 during use of the apparatus 1. The counterweight 58 is U-shaped to provide an undercut so that the band 67 can pass freely beneath the paddle assembly 45, as shown. The hand tracks 26, 27 are preferably provided with suitable markings (not shown) located at spaced intervals for purposes of recording and/or establishing the adjustments desired for a particular user.

The forwardmost end of each of the bands 67 receives a cable 73 that extends forward, from each of the paddle assemblies 45 toward a pair of pulleys 74 attached to the post 33 of the pedestal 25. The cables 73 are formed of a durable material to provide a useful service life, with preferred materials including metallic, and nylon or blended fiber weaves. The pulleys 74 are preferably associated with the post 33 of the pedestal 25 so that the line of travel developed for the cables 73 will not vary appreciably as the hand tracks 26, 27 are raised and lowered, or otherwise adjusted as previously described. The pulleys 74 operate to redirect the cables 73 toward a control panel 75, which is preferably associated with the base 29 of the pedestal 25 so that the control panel 75 will be generally aligned with the user's head, and within reach of the user's hands. In this way, the user is able to view and adjust the control panel 75 during use of the apparatus 1.

The cables 73 are received by, and are wound about a windlass 76 located within the control panel 75. Winding the cables 73 about a single windlass 76 operates to couple and coordinate movements of the paddle assemblies 45 associated with the hand tracks 26, 27. In particular, as one of the paddle assemblies 45 (i.e., the "leading" paddle 55) is being pulled back, the other paddle assembly 45 (i.e., the "trailing" paddle 55, which would at that point be positioned along the opposing thigh of the user) will be caused to travel forward responsive to the pull of the associated cable 73 (which will be drawn by the windlass 76 as the leading paddle assembly 45 is pulled back by the user). As a result of this interaction, the trailing paddle 55 will be drawn into a leading position, for engagement by the opposing hand (to begin its stroke) following completion of the push by the initial arm, along the thigh. The elastic bands 57, combined with the counterweight 58 and/or the elastic band 63, operate to return the paddle 55 to the neutral position which is appropriate for properly receiving the user's hand during the entry portion of the next stroke to be simulated as the paddle assembly 45 is drawn forward by the cable 73, as previously described. In this way, the paddle assembly 45 and the paddle 55 are automatically made ready to receive the user's hand during the next simulated entry, promoting the development of a proper swimming stroking. At the same time, the arm (and hand) in the process of recovery (i.e., following the push) will be permitted to rise above the user's body, unencumbered by structures of the swim training apparatus 1, as that arm reaches for the beginning of another stroke.

The windlass 76 is further coupled with appropriate sensors (not shown) for converting the movements of the cables 73 into electrical signals for processing by the control panel 75, using techniques that are themselves well known in the industry. The resulting electrical signals are then processed to provide the user of the apparatus 1 with desired information pertinent to the training process. For example, the user can be provided with an indication of elapsed time, using an analog display 77 or a digital display 78, or distance, using the display 79. Various features can also be provided for the convenience of the user such as on/off/reset controls 80, pause controls 81, audible prompts (responsive to the controls 82) or skill level adjustment (using the level controls 83 and/or by varying the parameters established for the routine, using the controls 84). It is to be understood that any of a variety of other performance/convenience features can be implemented, as desired.

Interaction between the cables 73 and the windlass 76 allows each complete arm pull (of the relevant paddle assembly 45) to be converted to a measurable distance, allowing the user to measure the success of a workout and to customize workout sessions. The data obtained (in yards and/or in meters) will allow the user to plan a workout similar to a workout typically performed in a pool.

For example, let it be assumed that a typical workout to be performed in a pool by an experienced swimmer is to include the swimming of 100 yards, 10 times consecutively, at intervals of 1 minute and 30 seconds. Using the apparatus 1 to simulate such a workout, the user would lie down on the tray 15 of the table 2 and press the "on" switch 80. The level of the workout can then be set at 83, for example, by entering a measure between 1 (least resistance) and 10 (greatest resistance). The interval distance can also then be set, if desired, at 85. At this point, the user may decide to swim without customizing a workout, in which case the time 78 and distance 79 meters will begin upon the first pull of one of the paddle assemblies 45. If a custom workout is desired, the user can then indicate the desired interval distance at 85 (e.g., in increments of 25 yards, or meters), the desired interval time at 86 (e.g., in minutes and seconds in increments of 5 seconds) and the desired repetition rate at 87 (e.g., in single digit increments). Once entered, the workout will again begin upon the first pull of one of the paddle assemblies 45.

The interval timer 86 will then begin its countdown (in the present example, from 1 minute and 30 seconds to 0) upon the first pull of the paddle assembly 45, indicating that the user has begun the workout. This countdown will then continue, repetitively for as many repetitions as the user has selected. As the interval distance is being counted with each arm stroke, an audible signal (e.g., a beep) may be sounded to inform the user that he or she is approaching (e.g., within 5 yards) the programmed interval distance and the yard counter will pause upon reaching the desired count. In a proper workout, the user will have a short rest period before the start of another interval (e.g., before hearing the interval timer beep, indicating a 3 second warning before the start of another interval). The repeat counter 87 then displays one less interval remaining, and the interval distance counter 85 will start a recount (from 1 to 100 yards) with the next stroke (i.e., the next pull of one of the paddle assemblies 45). If the user has not achieved the distance goal which has been set (i.e., 100 yards) by the time the clock has restarted the next interval count-up, the swimmer can then adjust the interval time or distance, as desired, anytime during the workout. The total workout time 78 and total distance 79 meters will continue unless the control panel 75 is turned off at 80, or the pause button 81 is operated (which then freezes the counters 78 and 79 so that a workout can be interrupted without losing information). More sophisticated features which might be appreciated by competitive swimmers could include allowing the user to enter a desired number of strokes per distance interval, based upon actual experience in a pool. The control panel could then use this information to allow a more personalized experience while training.

During the training session, the user will lie horizontally on the tray 15, simulating the orientation of a swimmer when in the water. When in position on the tray 15, the swimmer will be centrally located relative to the hand track system 3, within arm's reach of the control panel 75 to facilitate programming and control of the workout. Since rotation of the body is important in swimming, the tray 15 of the apparatus 1 is moveable so that the user can sway from side to side with each arm stroke. This, combined with the unique attributes of the hand track system 3, allows the user to recreate a more realistic water swim motion.

As previously indicated, correct freestyle swimming requires the proper execution of five elemental components, including hand entry, pull, body rotation, push and elbow recovery. The swim training apparatus 1 operates to promote the proper execution of these components as follows.

Figure 11A:
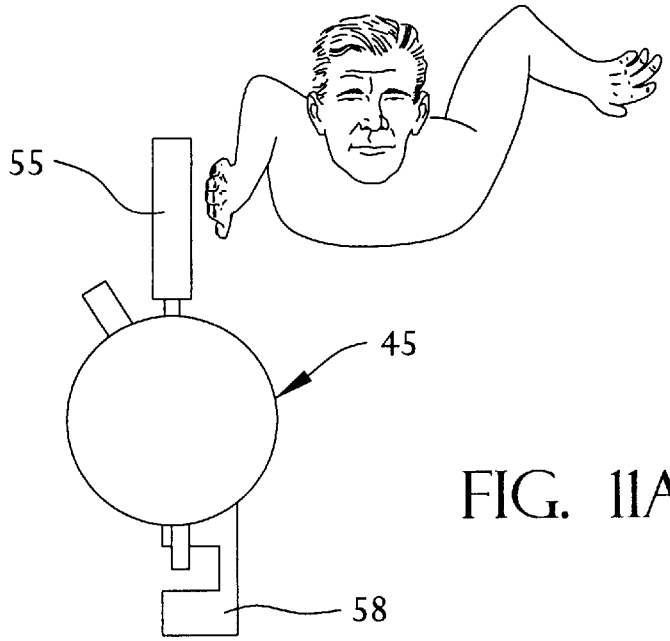
FIGS. 11A through 11C are sequential schematic views showing how the paddle assemblies of the swim training apparatus operate to simulate a swimming stroke, as viewed from the front.
Figure 12A:
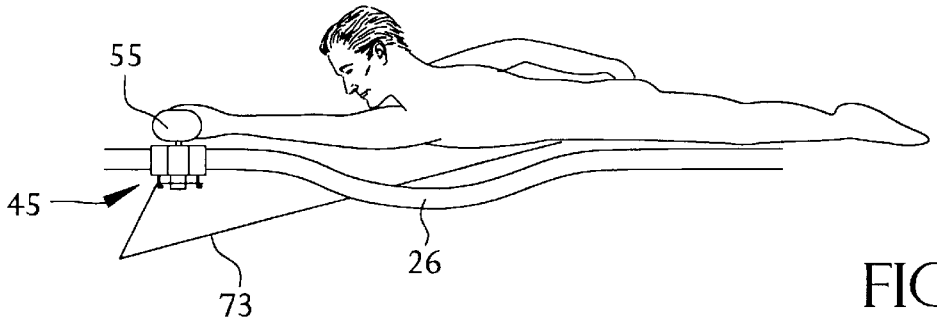
FIGS. 12A through 12D are sequential schematic views showing how the track system of the swim training apparatus operates to simulate a swimming stroke, as viewed from the side.
Figure 13A:
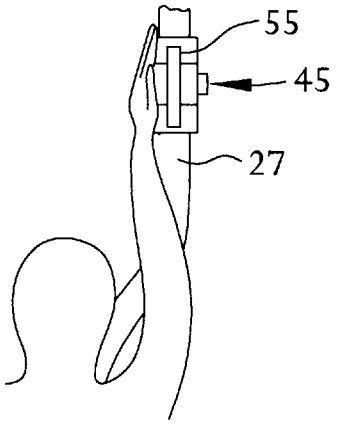
FIGS. 13A through 13E are sequential schematic views showing how the track system of the swim training apparatus operates to simulate a swimming stroke, as viewed from the top.

During entry, the hand should penetrate the surface of the water with the palm facing outwardly and with the thumb facing downwardly, to in essence "cut" into the water as smoothly as possible without slapping the water's surface or creating bubbles. Referring to FIGS. 11A, 12A and 13A, this is promoted by the initial position assumed by the paddles 55 associated with the paddle assemblies 45, which is biased toward an orientation for properly receiving the user's hand (and the arm, which follows) during the simulated hand entry.

The hand will then continue to slide forward until a full extension is reached, which will also generally result in some rotation of the torso (which is simulated by rotation of the tray 15). At the point when the hand entering the water can reach no further, with the shoulder fully extended (causing the torso to begin a rotation), the opposite hand will be finishing the final stages of its stroke and will be lifted from the paddle 55 of the corresponding paddle assembly 45 (simulating lifting of the hand/arm from the water).

Figure 11B:
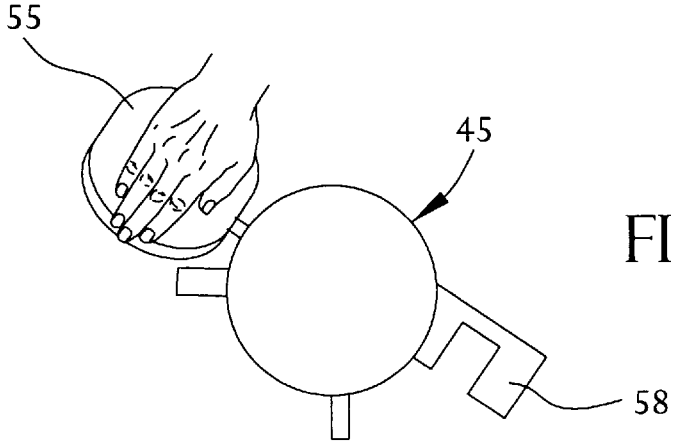
Figure 11C:
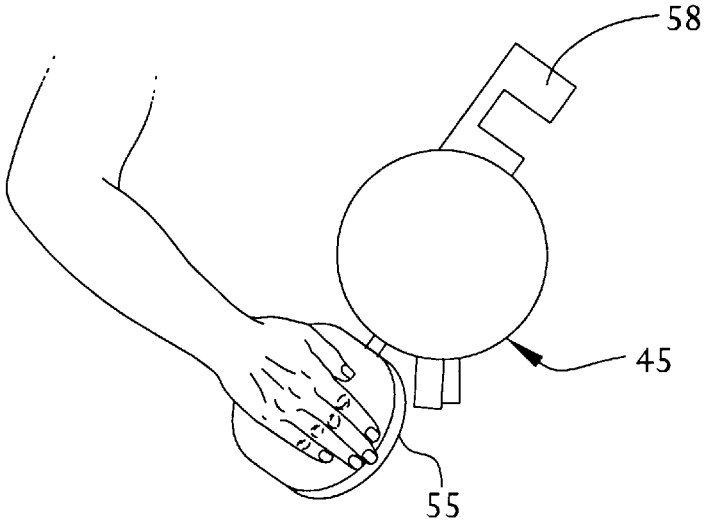
Figure 12B:
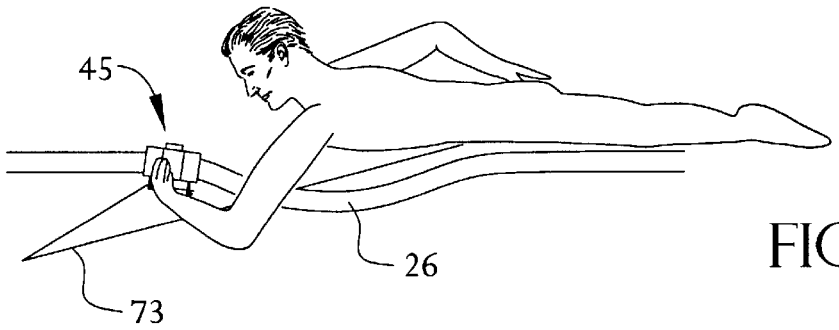
Figure 12C:
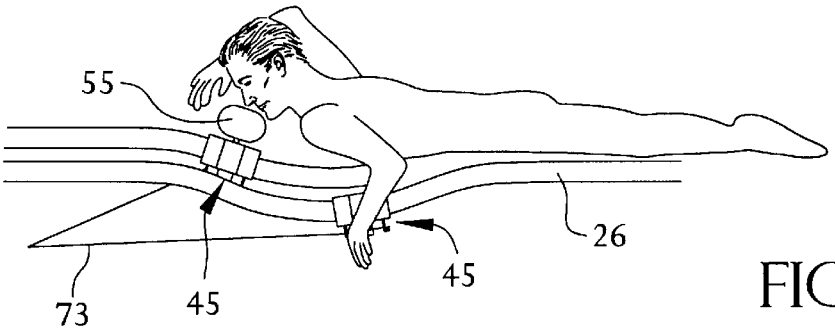
Figure 13B:
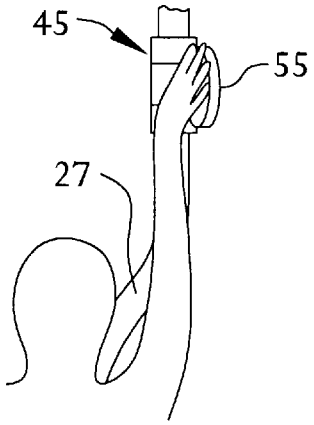
Figure 13C:
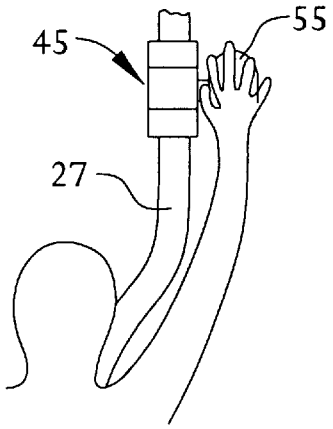
Figure 13D:
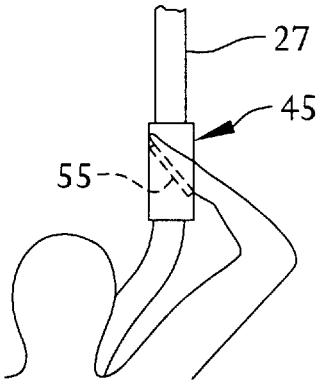
Figure 13E:
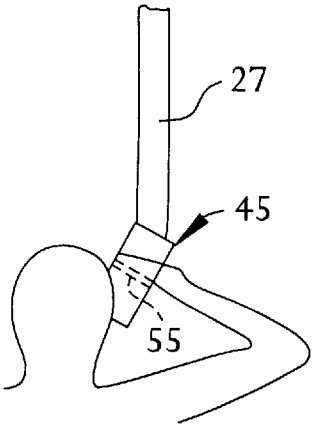

The entering hand will then begin its pull backward (while flexing the hand and cupping the water), developing the paddle which is desired for propelling the body forward. Proper rotation of the hand from the orientation desired for entry to the orientation desired for the pull is again promoted by rotation of the paddle 55 associated with the paddle assembly 45 being engaged, as is best shown in FIGS. 11B and 11C, and in FIGS. 13B and 13C. During the pull, the elbow is bent and the hand is carried from its point of full extension through a path in front of the chest, and then back toward the side of the thigh, to produce what is essentially an "S-shaped" motion. Movement of the hand along this path is promoted by the shape of the hand tracks 26, 27, as is best shown in FIGS. 12B and 12C, and in FIGS. 13D and 13E. The body will naturally rotate as the lead hand is extended to its limit, and such rotation is again effectively accommodated by movement of the tray 15. This also facilitates the simulation of proper breathing, by turning of the user's head at this point of the stroke.

Figure 12D:
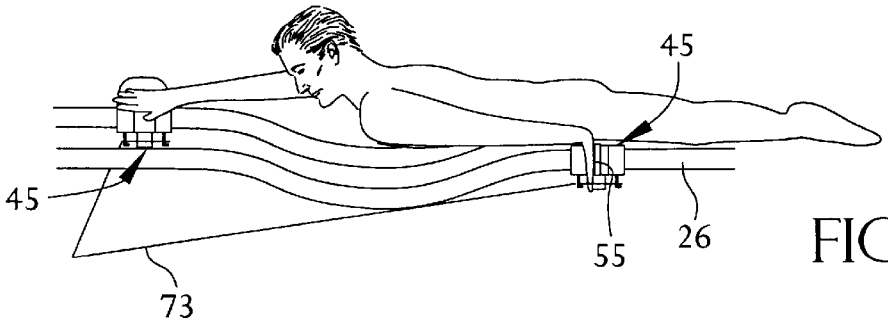

Referring to FIGS. 12C and 12D, movement of the paddle assembly 45 along the hand track 26 also trains the swimmer to initiate a final push of the flexed hand down along the thigh, as is preferred to make use of the momentum of the paddling hand to propel the body even further. This helps eliminate the tendency for the swimmer to take the hand out of the water when the pulling arm reaches the waist, while the elbow is still bent, which is counter-productive to a proper freestyle stroke.

Following this, the hand is lifted from the paddle assembly 45, simulating exit from the water. Since the hand is no longer coupled with the paddle assembly 45, the hand is made free to simulate a proper arm recovery (i.e., with the elbow raised high to allow the forearm and hand to dangle and rest completely as the hand is brought forward to prepare for the next entry).

As the swimmer stretches an arm overhead, as far as possible, the accompanying shoulder will tend to follow causing the rest of the body to move with it. An efficient swimmer will control this body distortion and keep the body as streamlined as possible during such rotation. In this way, the hips and legs will not fall out of alignment as the swimmer rotates, tending to prevent excessive water drag and less efficient swimming. The tray 15 allows the user to learn proper rotation by eliminating this potential for lateral hip movement. Once the opposing arm starts its outreach, the body will starts its motion back toward center, and then beyond center, as a result of the outward stretching of that arm and shoulder. As a result, the natural twist and rotation in the direction of the body is replicated during this reach phase.

It will be understood that various changes in the details, materials and arrangement of parts which have been herein described and illustrated in order to explain the nature of this invention may be made by those skilled in the art within the principle and scope of the invention as expressed in the claims which follow.

For example, and as previously indicated, while the foregoing swim training apparatus 1 has been described for use in simulating a freestyle stroke, a similarly configured apparatus can be used to simulate other strokes by appropriately modifying the shape, the configuration and/or the relative position of the various components which comprise the swim training apparatus 1 (primarily the tray 15, hand tracks 26, 27 and paddle assemblies 45). For certain strokes, such as the breaststroke and the butterfly stroke, additional modifications will have to be made to the windlass 76 and its associated sensors to accommodate the necessary movements of the user's arms while performing such strokes (i.e., in the same direction, at the same time). This can be accomplished using a split windlass structure including a separate windlass for receiving each of the cables 73. Each of the two windlasses (schematically shown at 76' in FIG. 2) would then include appropriate (separate) sensors 88 for monitoring movements of the corresponding cables responsive to movements of the paddle assemblies 45 by the user, which would in such cases be in unison rather than the opposing movement of a freestyle stroke. A retraction mechanism (e.g., the spring driven device schematically shown at 89 in FIG. 3, or an automated retraction device) would in such cases be required to return the paddle assemblies 45 to their extended positions, for engagement by the user's hands at the commencement of the following stroke.

Figure 14:
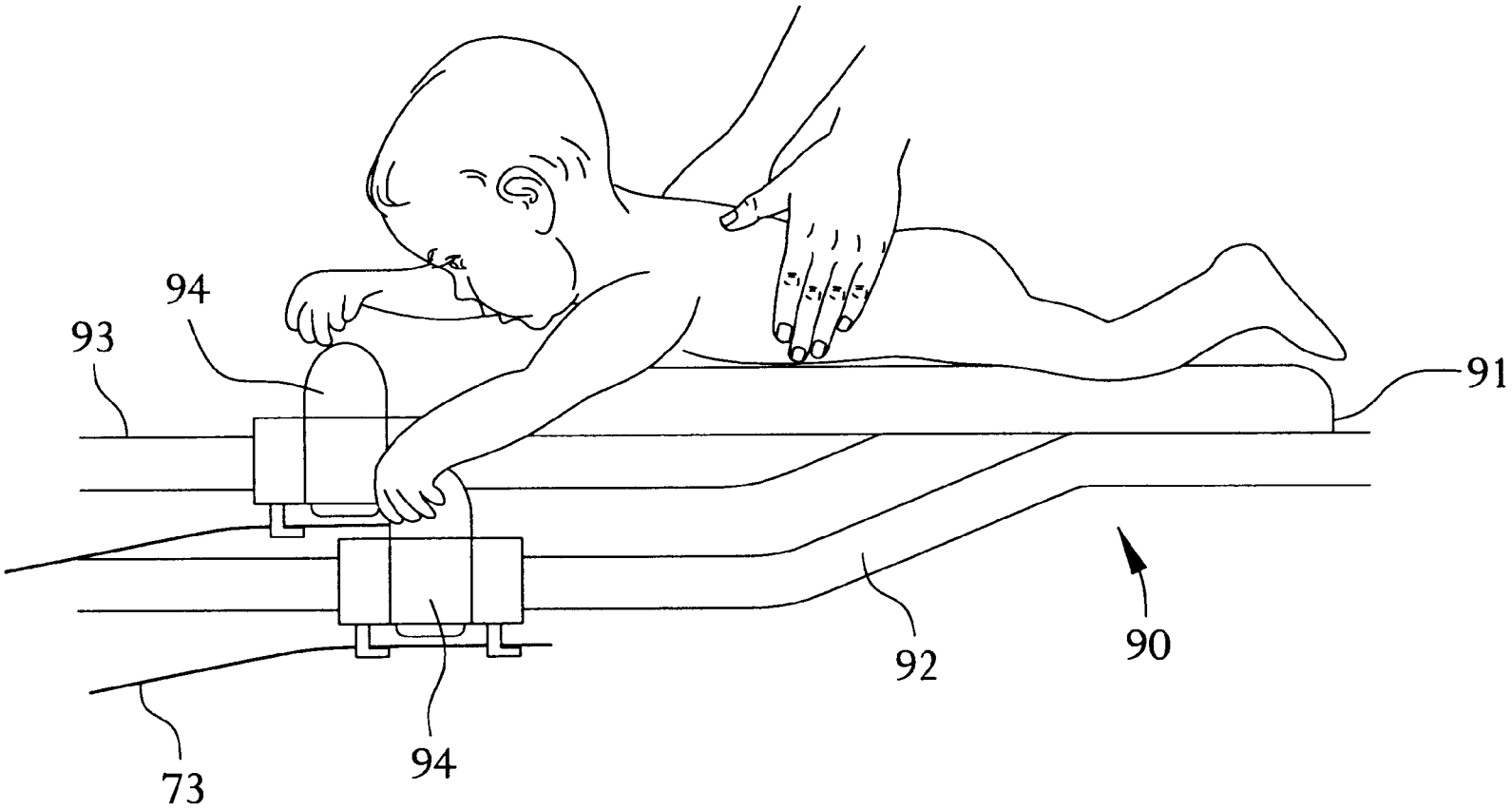
FIG. 14 is a schematic view of an alternative embodiment paddle assembly and track system for use in simulating a simplified swimming stroke, for an infant, toddler or small child.

As a further example, FIG. 14 shows a simplified swim training apparatus 90 which is useful in teaching basic swimming techniques to young children. In this configuration, the table 2' is fitted with a stationary tray 91 to promote confidence, and since the more advanced techniques such as body rotation are no longer of primary concern. The hand tracks 92, 93 are modified in shape to define a simplified stroke-developing path, and simplified paddles 94 are provided which are more easily grasped and which promote cupping of the hands during the simulated stroke. For such an application, refinements such as the control panel 75 may be deleted for simplicity, and steps can be taken to enclose the cables 73 for purposes of safety, if desired.

Other modifications, both simplified and more complex, are equally possible to meet desired training goals.

What is claimed is:

1. An apparatus for facilitating practice of a swimming stroke by a user, comprising:

a table for receiving the user so that hands and arms of the user are free for movement and so that body portions of the user are supported in a position simulating a position of the user while in water; and a hand track system adjacent to the table, wherein the hand track system includes paddle assemblies having paddle grips which are releasably engaged by the hands of the user during the practice of the swimming stroke; wherein the swimming stroke has a first portion simulating the position during which the hands and arms of the user are in the water and a second portion simulating the position during which the hands and arms of the user are out of the water, and wherein the paddle grip is positioned relative to the table, and configured for engagement by the hands of the user during the first portion of the swimming stroke and for release by the hands of the user during the second portion of the swimming stroker.

2. The apparatus of claim 1 wherein the table includes a base for resting upon a supportive surface, a frame for receiving and supporting the user above the surface so that the hands and arms of the user are free for movement without contacting the surface, and a plurality of struts connecting the base and the frame so that the frame is spaced over the base.

3. The apparatus of claim 2 wherein the struts are telescoping struts so that the frame is made adjustable in height relative to the base.

4. The apparatus of claim 3 which further includes a lock for securing the telescoping struts following an adjustment in height.

5. The apparatus of claim 2 which further includes a tray positioned on the frame, for receiving the body portions of the user, wherein the tray is supported for movement relative to the frame.

6. The apparatus of claim 5 wherein the body portions of the user define a longitudinal axis, and wherein the tray is supported on the frame so that the tray is free to rotate about an axis which substantially corresponds to the longitudinal axis defined by the body portions of the user.

7. The apparatus of claim 5 wherein the frame and the tray include a curved track, and a correspondingly curved race for engaging the track.

8. The apparatus of claim 5 wherein the frame and the tray include a channel for receiving a corresponding stop, for limiting movement of the tray relative to the frame.

9. The apparatus of claim 2 which further includes a control panel positioned ahead of and beneath the table, in general alignment with upper body portions of the user.

10. The apparatus of claim 2 which further includes an elastic band attached to and extending between the tray and stationary portions of the table, for stabilizing the tray relative to frame.

11. The apparatus of claim 1 wherein the hand track system includes a pair of hand tracks positioned on opposing sides of the table, and wherein each hand track includes a paddle assembly.

12. The apparatus of claim 11 wherein each hand track is contoured, and wherein the contour is shaped to simulate movement of the hands and arms of the user while practicing the swimming stroke.

13. The apparatus of claim 12 wherein each hand track is comprised of a plurality of track sections.

14. The apparatus of claim 11 wherein the hand tracks are supported between a pedestal positioned forward of the table and a support positioned along rear portions of the table, so that the hand tracks are freely suspended between the pedestal and the support.

15. The apparatus of claim 14 wherein the hand tracks include end portions that are slidingly engaged at the pedestal and at the support, so that the hand tracks are laterally adjustable relative to the table.

16. The apparatus of claim 14 wherein the pedestal includes a base for resting upon a supportive surface, a frame for receiving and supporting the hand tracks above the surface, and a strut connecting the base and the frame so that the frame is spaced over the base.

17. The apparatus of claim 16 wherein the strut is a telescoping strut so that the frame is made adjustable in height relative to the base.

18. The apparatus of claim 17 which further includes a lock for securing the telescoping strut following an adjustment in height.

19. The apparatus of claim 14 which further includes a control panel associated with the pedestal and positioned ahead of and beneath the table, in general alignment with upper body portions of the user.

20. The apparatus of claim 11 wherein the paddle assembly includes a sleeve for slidingly engaging one of the hand tracks, and a mounting for rotatably engaging the sleeve and receiving the paddle grip.

21. The apparatus of claim 20 wherein the sleeve defines a longitudinal axis which extends generally parallel to the hand track, and wherein the paddle grip is rotatable about the longitudinal axis defined by the sleeve.

22. The apparatus of claim 21 wherein the mounting further includes a stop for engaging fixed portions of the apparatus, for limiting rotation of the paddle grip about the longitudinal axis.

23. The apparatus of claim 21 wherein a shaft connects the mounting and the paddle grip, wherein the shaft defines an axis, and wherein the paddle grip is additionally rotatable about the axis defined by the shaft.

24. The apparatus of claim 23 which further includes an elastic band attached to and extending between the paddle grip and the mounting, for biasing the paddle grip into an orientation which is generally aligned with the hand track.

25. The apparatus of claim 21 which further includes an elastic band attached to and extending between the mounting and the sleeve, for biasing the paddle grip into a generally vertical orientation.

26. The apparatus of claim 21 which further includes a counterweight attached to and extending from the mounting, for biasing the paddle grip into a generally vertical orientation.

27. The apparatus of claim 20 wherein the sleeve further includes a roller positioned within inner portions of the sleeve, for engaging a groove formed in the hand track engaged by the paddle assembly.

28. The apparatus of claim 27 which includes a pair of rollers associated with the sleeve, for engaging the hand track.

29. The apparatus of claim 20 which further includes a cable coupled with the paddle assembly and extending between the paddle assembly and a control panel associated with the apparatus.

30. The apparatus of claim 29 wherein the cable is operatively coupled with the sleeve of the paddle assembly.

31. The apparatus of claim 30 wherein the cable is adjustably coupled with the sleeve of the paddle assembly.

32. The apparatus of claim 31 which further includes a band connected with the cable and having a plurality of apertures formed along the band, and wherein the sleeve includes a bracket for selectively engaging the apertures formed in the band.

33. The apparatus of claim 32 which further includes an adjustment pin associated with the bracket, for selectively engaging the apertures formed in the band.

34. The apparatus of claim 29 wherein a separate cable is associated with each of the paddle assemblies, and which further includes a windlass for receiving the cables associated with the paddle assemblies.

35. The apparatus of claim 34 wherein the cables are associated with a single windlass so that retraction of one of the paddle assemblies, toward rearward portions of the apparatus, automatically draws the other one of the paddle assemblies toward forward portions of the apparatus.

36. The apparatus of claim 34 wherein the cables are associated with a pair of windlasses so that both of the paddle assemblies can be simultaneously drawn toward rearward portions of the apparatus by the user.

37. The apparatus of claim 36 which further includes automated means for drawing the paddle assemblies toward forward portions of the apparatus, following release of the paddle assemblies by the user.

38. The apparatus of claim 34 wherein the windlass is associated with the control panel, and wherein the control panel further includes a sensor coupled with the windlass, for monitoring movement of the cables associated with the windlass.

39. The apparatus of claim 38 wherein the control panel further includes a display coupled with the sensor, for indicating parameters associated with movements of the paddle assemblies.

40. The apparatus of claim 39 wherein the control panel further includes controls for use in regulating operations of the apparatus associated with the practice of the swimming stroke.

41. A method for facilitating practice of a swimming stroke by a user, comprising the steps of:

simulating positioning of the user while in water by supporting body portions of the user on a table for receiving the user so that hands and arms of the user are free for movement;

positioning a hand track system adjacent to the table, within reach of the hands and arms of the user, wherein the hand track system includes paddle assemblies having paddle grips; and releasably engaging the paddle grips with the hands of the user during the practice of the swimming stroke, simulating the swimming stroke when in the water; wherein the swimming stroke has a first portion simulating the position during which the hands and arms of the user are in the water and a second portion simulating the position during which the hands and arms of the user are out of the water, and which further includes the steps of engaging the paddle grips with the hands of the user during the first portion of the swimming stroke and releasing the hands of the user from the paddle grips during the second portion of the swimming stroke.

42. The method of claim 41 wherein the table includes a tray for receiving the body portions of the user, wherein the body portions of the user define a longitudinal axis, and which further includes the step of supporting the tray on the table so that the tray is free to rotate about an axis which substantially corresponds to the longitudinal axis defined by the body portions of the user.

43. The method of claim 42 which further includes the step of limiting rotation of the tray relative to the table.

44. The method of claim 42 which further includes the step of stabilizing the tray relative to the table.

45. The method of claim 41 wherein the hand track system is contoured, and which further includes the step of drawing the hands and arms of the user along the contour of the hand track system to simulate movement of the hands and arms of the user while practicing the swimming stroke.

46. The method of claim 41 wherein the paddle assemblies include a sleeve for slidingly engaging portions of the hand track system, and a mounting for rotatably engaging the sleeve and receiving one of the paddle grips, wherein the sleeve defines a longitudinal axis which extends generally parallel to the hand track system, and which further includes the step of rotating the paddle grip about the longitudinal axis defined by the sleeve responsive to forces developed by the hands and arms of the user.

47. The method of claim 46 wherein a shaft connects the mounting and the paddle grip, wherein the shaft defines an axis, and which further includes the step of rotating the paddle grip about the axis defined by the shaft.

48. The method of claim 47 which further includes the step of biasing the paddle grip toward an orientation which is generally aligned with the hand track.

49. The method of claim 48 which further includes the step of biasing the paddle grip toward a generally vertical orientation.

50. The method of claim 46 which further includes the step of retracting one of the paddle assemblies, toward rearward portions of the apparatus, while automatically drawing the other one of the paddle assemblies toward forward portions of the apparatus.

51. The method of claim 46 which further includes the step of simultaneously drawing both of the paddle assemblies toward rearward portions of the apparatus by the user.

52. The method of claim 51 which further includes the step of automatically drawing the paddle assemblies toward forward portions of the apparatus, following release of the paddle assemblies by the user.

53. The method of claim 41 which further includes the step of monitoring movements of the paddle assemblies during the practice of the swimming stroke.

54. The method of claim 53 which further includes the step of indicating parameters associated with movements of the paddle assemblies, responsive to the monitoring step.

* * * * *